United States Patent [19]

Lindmayer et al.

[11] Patent Number: 4,941,569

[45] Date of Patent: Jul. 17, 1990

[54] KEY CASE HAVING A SWING-OUT FLAT KEY

[75] Inventors: Martin Lindmayer, Böblingen; Rudi Kneib, Sindelfingen; Günther Weikert, Weil der Stadt; Wolfgang Schneider, Calw; Rolf Krügener; Klaus-Peter Claar, both of Sindelfingen, all of Fed. Rep. of Germany

[73] Assignee: Daimler-Benz AG, Fed. Rep. of Germany

[21] Appl. No.: 436,039

[22] Filed: Nov. 14, 1989

[30] Foreign Application Priority Data

Dec. 20, 1988 [DE] Fed. Rep. of Germany ..... 3842790

[51] Int. Cl.[5] ..... A45C 11/32; A45C 15/00

[52] U.S. Cl. ..... 206/38.1; 206/37.1; 206/37.2; 70/456 R

[58] Field of Search ..... 206/37.1, 38.1, 37.2, 206/38, 37; 70/456 R

[56] References Cited

U.S. PATENT DOCUMENTS

| | | | |
|---|---|---|---|
| 1,889,471 | 11/1932 | Glaenzer | 206/38.1 X |
| 2,232,333 | 2/1941 | McGehee | 206/38.1 X |
| 2,822,684 | 2/1958 | Ray | 70/456 R |
| 4,524,594 | 6/1985 | Bascou | 220/253 X |
| 4,646,913 | 3/1987 | Wing et al. | 206/37.2 |

FOREIGN PATENT DOCUMENTS

| | | | |
|---|---|---|---|
| 482277 | 4/1952 | Canada | 70/456 R |
| 1812126 | 5/1960 | Fed. Rep. of Germany . | |
| 7102327 | 5/1971 | Fed. Rep. of Germany . | |
| 2226389 | 9/1982 | Fed. Rep. of Germany . | |
| 3314072 | 1/1985 | Fed. Rep. of Germany . | |
| 2609304 | 7/1988 | France | 206/38.1 |
| 631526 | 1/1962 | Italy | 70/456 R |

*Primary Examiner*—William Price

*Attorney, Agent, or Firm*—Evenson, Wands, Edwards, Lenahan & McKeown

[57] ABSTRACT

The invention relates to a rectangular key case having a swing-out flat key, so that the key can be integrated into the case in a space-saving manner. The case contains a key receiving space formed as a two-legged receiving shaft which, viewed over its length, is essentially L-shaped and extends with its longer leg along the side edge and with its shorter leg along the front edge of the key case housing. The flat key, in its non-working position, is lowered with its shank part entering into the longer leg and with its grip part entering into the shorter leg located near the corner of the key case housing. The shank part of the flat key is pivoted outside the housing and around its corner with the flat key in a working position pointed in the opposite direction from its non-working position and whereupon the grip part of the key engages into a longitudinal area of the shorter leg more remote from the corner.

9 Claims, 1 Drawing Sheet

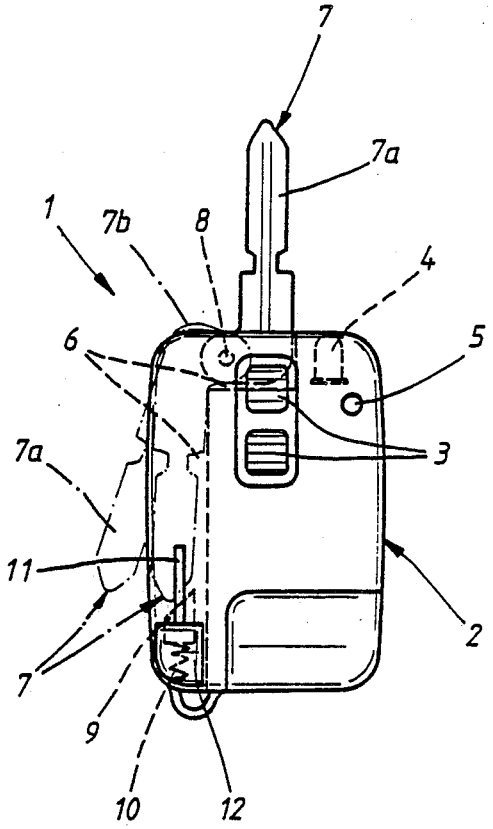
7
7a
1
7b
8
4
6
5
3
7a
11
2
7
9
10
12

KEY CASE HAVING A SWING-OUT FLAT KEY

BACKGROUND AND SUMMARY OF THE INVENTION invention relates to a key case having a swing-out flat key and a slotted passage opening for the flat key, which passage opening extends continuously over a corner of the key case and an adjoining longitudinal section of a front and side edge of the key case and which merges into a receiving space for the flat key. The flat key has a grip part and a shank part angled approximately perpendicularly thereto and is lowered into its non-working position. The flat key is articulatedly mounted on the key case in an area near to a free end part of its grip and wherein the articulation point lies in an area near to the front edge of the key case and at a lateral distance from both the corner of the key case and the center longitudinal axis of the key case and wherein the shank part of the flat key projects from an approximate center of the front edge of the key case in its swung-out working position.

German Patent Specification No. 2,226,385 discloses a key case of this general type. There the key case forms a turning grip for the key shank when the flat key is swung out. The key case is distinguished by a compact external form of small breadth, as a result of which the flat key is also suitable for actuating sunken locking cylinders. This suitability is further improved by the key-case front edge (located on the insertion side) being shortened to a minimum, while the key case widens trapezoidally with increasing distance from the front edge. To enable the long shank part to be sunk in the widened longitudinal section of the key case, the flat key is articulated on the key case via its grip part, which guides the key shank like an extension arm. In addition, the grip part enables a turning force to be gently transmitted from the key case to the shank part, since, in its working position, it lies in its receiving space in an essentially positive-locking manner and with its entire longitudinal extent between the broad sides of the key case. Thus no excessive bending stability of the key case is necessary.

However, the turning force must be supported between the housing and the key shank almost entirely via the mounting axis of the key shank. This type of support for the turning force requires an exceptionally robust pivot mounting of the key shank in the key case housing as well as corresponding bending rigidity of the key case housing itself.

In addition, since the key shank, in its working position, projects from a longitudinal edge of the housing, its utility, on account of the turning swing associated therewith, is considerably limited. Thus sunk locking cylinders as well as locking-cylinder insertion openings surrounded by raised contours can only be reached by means of an extra-long key shank. However, an extra-long key shank is not desirable either from the points of view of handling or of strength.

The object of the invention is therefore to improve a key case having a swing-out flat key as defined in the first paragraph of this application without occupying much construction space for accommodating the key and by integrating the key into a key case housing which is also a carrier for an additional function.

This object is achieved by having the key case designed as an elongated housing with a key receiving space shaped as a two-legged receiving shaft which, viewed over its length, is essentially L-shaped and extends with its longer leg along the side edge and with its shorter leg along the front edge of the key case housing. A flat key, in its non-working position, is pivoted into a lowered position with its shank part extending into the longer L-shaped leg and with its grip part into a longitudinal area of the shorter L-shaped leg and near the corner of the key case housing. The shank part of the key can be pivoted outward of the housing around its corner through which the flat key passes into a working position pointed in the opposite direction from its lowered non-working position and whereupon the grip part of the key also is pivoted into a longitudinal area of the shorter leg more remote from the corner than the pivot point. By this construction it is possible to reduce the length of the front edge on the operating side of the housing to a size which corresponds to the diameter of conventional locking cylinders. In combination with a slim, rectangular key shaped housing of the same breadth, mechanical lock operation by means of the swung-out flat key is thus possible both in sunken locking cylinders and in locking cylinders surrounded by raised contours.

The flat key, in its non-working position, is preferably sunk in the receiving shaft area in such a way that the key edges are flush with the key housing and as a result of which, key grooves are protected from dirt. Damaging or dirtying of key case receptacles such as clothes pockets, handbags or the like, by parts of the flat key which protrude from the key case is thus reliably avoided. The bottom of the receiving shaft, which at the same time forms the allocated boundary wall of the key case housing, can be used to limit the swing-in or swing-out throw of the flat key. To this end, the depth of the lateral leg of the receiving shaft must correspond to the breadth of the shank part, and the depth of the front leg must correspond to the breadth of the grip part.

However, in the front leg of the receiving shaft, this depth is only sufficient if it provides the necessary pivoting space for the mounted end of the grip part. If the mounted end is provided with a semicircular rounded front edge section having a radius of half the breadth of the grip part that merges into the parallel side edges of the grip part, this condition is fulfilled. Thus the depth of the front leg (up to the corner of the receiving shaft) can be constant over its entire length.

If the breadth of the grip part matches the blank of the shank part, both legs of the receiving shaft, viewed over their length, can have an identical, constant shaft cross-section.

The corner of the housing through which the receiving shaft passes as well as the other outer corners and outer edges of the housing should be rounded off in such a way that they are convenient to grip in order to avoid injuries or damage. Accordingly, a corner of the flat key is adapted to correspond to the path of the corner curvature of the key case and is of constant breadth. Hence the flat key remains torsionally rigid in its transition area from the grip part to the shank part. The outer edge curvature of the key should correspond to half the breadth of the shank part.

The flat key, like a conventional flat key, is preferably of one-piece design, as a result of which its blank is inexpensive to produce.

When the key case is combined with a transmitter housing which has a signal emitting device with directional effect it is possible to have the signal emitting direction correspond to the key insertion direction. The gripping position of a user's operating hand (holding the key case) can thereby stay the same irrespective of the type of operation (key or transmitter).

Other objects, advantages and novel features of the present invention will become apparent from the following detailed description of the invention when considered in conjunction with the accompanying drawing.

BRIEF DESCRIPTION OF THE DRAWING

The Figure shows an exemplary embodiment of the key case of the invention in diagrammatic representation.

DETAILED DESCRIPTION OF THE DRAWING

The figure shows a schematic side view of a key unit 1 in which a key case for a normal key and a case for an electronic key are combined into a single housing 2. The extremely flat housing 2 (shown roughly to full size) is made of impact-resistant plastic and has a handy rectangular format. All corners and edges of the housing 2 are rounded off in such a way that it is convenient to grip. For reference the horizontal top side of the housing is designated its front edge. The inner space of the housing 2 is predominantly occupied by the components for the electronic key, which consists of a semiconductor board assembly of an infrared transmitter and an allocated energy accumulator integrated therewith. Operating or control elements for the transmitter of the electronic key are visible from the outside of the housing 2 and include two sensor buttons 3 for releasing a closing and opening signal, a light emitting diode 4 as signal emitting device, and a charge indicator 5 for an energy accumulator Power source for the electronic key. The light emitting diode 4 is recessed into the front edge of the area near to a corner of the housing 2. It is completely recessed in the peripheral contour of the housing 2. Since the center longitudinal axis of the light emitting diode 4 runs parallel to the center longitudinal axis of the housing 2, the light emitting diode 4 emits its signal in a direction at right angles to the longitudinal extent of the front edge of the housing 2.

The front edge of the housing 2 is recessed laterally and offset relative to the light emitting diode 4 to form a receiving shaft area 6. A narrow shaft portion runs continuously along the front edge and through the corner remote from the light emitting diode 4 and down along the left side edge of the housing 2. Thus the receiving shaft 6, viewed over its entire length, has an inverted L-shape, the long leg of the receiving shaft 6 extending virtually over the entire length of the side edge, and the short leg extending over slightly more than half the length of the front edge of the housing 2. In this arrangement, both legs of the receiving shaft 6 are identical in their cross-section and are adapted to the maximum cross-section of width of an allocated flat key 7. In the front leg of the receiving shaft 6, this flat key 7 is fastened to the housing 2 by means of a pivot 8 and is pivotable from a non-working position, sunk in the receiving shaft 6 at the side of the housing 2, into a working position projecting centrally from the front edge of the housing 2, and vice versa. To this end, the flat key 7 has a shank part *7a* which merges (in one piece) into a grip part *7b* which is angled by 90° to the direction of longitudinal extent of the shank part *7a*. The grip part has a mounting bore for the pivot 8 in the area near to its free end. The narrow side of the end of the grip part *7b* is curved in a semicircular shape around the mounting bore, arranged in the center of the breadth of the handle part *7b*, and at a radius corresponding to half the breadth of the grip part. In this way, the grip part *7b* of the key does not need any pivoting clearance which would exceed the accommodation space for the grip part *7b*. The depth of the short leg of the receiving shaft 6 is therefore only marginally greater than the breadth of the grip part *7b*, the pivot 8 lying approximately at the center of the depth of the leg as well as at its longitudinal center.

By this arrangement, the length of the grip part *7b* is dimensioned in such a way that it extends up to the side edge of the housing 2 in its non-working position, where, in the corner area of the receiving shaft 6 (in which it merges into the shank part *7a*) it has an outer edge curved in a quarter-circle shape. The radius of curvature here corresponds to half the breadth of the grip part *7b* and thus runs in such a way that the edge is flush with the rounded-off internal housing corner of the shaft 6.

The adjoining shank part *7a* also lies in the lateral leg of the receiving shaft 6 in such a way that the edge of the key is flush with the housing 2. Thus the flat key 7, in its non-working position, is sunk in the housing 2 in such a way that its edge is flush over the entire length, which arrangement no longer provides direct access to the flat key 7.

Therefore a lifting mechanism is provided with which to Pivot the flat key 7 into a partly swung-out lifted position. To this end, a wedge slide 9 is arranged in the rear end area of the lateral leg of the receiving shaft 6. The wedge slide 9 is arranged so as to be guided in a sliding manner in the longitudinal direction of the leg. The wedge slide 9 is held by means of a tensioned restoring spring 10 in an inactive position in which it does not hinder the sinking action of the shank part *7a* of the key and is located at a slight distance opposite its free end. The wedge face of the wedge slide 9 interacts with the sloping end of the shank part *7a*. If the slide 9 is thus displaced upwardly toward the direction of the front edge of the housing 2 and against the tensioning of the restoring spring 10, the wedge face acts upon the narrow side of the shank part end of the key opposite the shaft bottom, as a result of which, the shank part *7a* is wedgingly swung out of the leg of the receiving shaft 6 into a lifted position indicated by broken lines. The end of the shank part *7a* which has thereby become accessible can now be grasped by the fingers of an operator and pivoted further.

So that it can be operated from outside the housing 2, the wedge slide 9 is connected with a slide knob 12 arranged on the outer surface of the housing 2 through an elongated hole 11 in such a way that the thumb of the operating hand can slide the knob throughout the longitudinal length of the elongated hole 11.

By lifting and subsequently pivoting the flat key 7 further, it can be pivoted out of its non-working position and through an angle of 180° into the working position extending outwardly of the front edge of the housing 2. The shank part *7a* is displaced parallel to the longitudinal center of the housing 2 in the course of the pivoting action about the pivot 8. Upon reaching the working position, the grip part *7b* strikes against the end-side boundary wall of the shorter leg of the receiving shaft 6, as a result of which, the flat key 7 is prevented from pivoting further. To simplify operation, however, it would be convenient to additionally lock the flat key 7 in its end positions so that in both directions there is a support to prevent pivoting.

Since the grip part 7*b* engages into the end area of the front leg of the receiving shaft 6 after the swing-out action, a favorable transmission of turning force from the housing 2 to the shank part 7*a* via the grip part 7*b* (located in a positive-locking manner in the receiving shaft 6) is obtained.

The receiving shaft 6 only occupies slightly more space of the housing 2 than is necessary for it to protectively retain the flat key 7 internal within itself.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A key case having a swing-out flat key and a slotted passage opening for the flat key;

the key case having an opening extending continuously over a corner of the case with merging adjoining longitudinal sections at a front and side edge of the key case for entry of the flat key into the key case;

wherein the flat key has a grip part and a shank part angled approximately perpendicularly hereto;

wherein the flat key is articulated on the key case via a pivot means engaging its grip part in an area near a free end of the flat key;

wherein the pivot means is located in an area near to the front edge of the key case and at a lateral distance from the aforementioned corner of the key case and from a center longitudinal axis of the key case;

wherein the shank part of the flat key, in a swung-out working position, projects from approximately the center of the front edgeof the key case;

wherein the key case is designed as an elongated rectangular housing;

wherein the passage opening provides a boundary for a key receiving space which is a two-legged receiving shaft which, viewed over its length, is essentially L-shaped and extends with the longer leg of the L-shape along the side edge and with the shorter leg of the L-shape along the front edge of the housing;

wherein the flat key, in its non-working position is pivoted into a lowered position with its shank part entering into the longer leg of the L-shaped receiving space and with its grip part into a longitudinal area of the shorter leg of the L-shaped housing space near the corner of the key case; and wherein the shank part of the flat key can be pivoted on the pivot means to travel outside the housing and around the aforementioned corner into a working position where the key shank part is pointed in the opposite direction from its non-working position and whereupon the grip part which is also pivoted the shank part engages into a longitudinal area of the shorter leg more remote from the aforementioned corner than the pivot means.

2. Key case according to claim 1, wherein a lateral distance of the pivot point from the center longitudinal axis of the key case housing corresponds to the pivoting length of the grip part of the flat key between a center longitudinal axis of the shank part of the flat key and the pivot point.

3. Key case according to claim 1, wherein the grip part of the flat key has virtually the same breadth as the shank part, and wherein both legs of the receiving shaft are identical in cross-section over most of their length.

4. Key case according to claim 1, wherein the flat key, in its non-working position, is completely enclosed in the receiving shaft in such a way that edges of the flat key are flush with edges of the key case housing over its length.

5. Key case according to claim 4, wherein the outer edge of the flat key is curved in a quarter-circle shape in a transition area between the shank part and the grip part.

6. Key case according to claim 1, wherein the flat key is of one-piece construction.

7. Key case according to claim 1, wherein a transmitter for cordless remote actuation of a lock system is also integrated into the key case housing.

8. Key case according to claim 7, wherein a signal emitting means for the transmitter is arranged on the front edge of the key case housing.

9. Key case according to claim 8, wherein the signal emitting means is a light emitting diode of an infrared transmitter, and wherein the light emitting diode is arranged to be located next to the swung-out shank part of the flat key in its working position and parallel and adjacent to an axis of the shank part of the flat key in its non-working position.

* * * * *